United States Patent [19]

Ellis

[11] 4,416,638

[45] Nov. 22, 1983

[54] APPARATUS FOR FEEDING FUEL TO A MARINE ENGINE

[76] Inventor: Frank Ellis, 56, Thamespoint, Fairways, Broom Rd., Teddington, Middlesex, England, TW11 9PP

[21] Appl. No.: 411,873

[22] Filed: Aug. 26, 1982

Related U.S. Application Data

[63] Continuation of Ser. No. 131,476, Mar. 18, 1980, abandoned.

[30] Foreign Application Priority Data

| | | | |
|---|---|---|---|
| Mar. 20, 1979 | [GB] | United Kingdom | 7909743 |
| Mar. 28, 1979 | [GB] | United Kingdom | 7910874 |
| Apr. 11, 1979 | [GB] | United Kingdom | 7912882 |

[51] Int. Cl.[3] ..... B63H 21/00

[52] U.S. Cl. ..... 440/88; 123/462

[58] Field of Search ..... 123/457, 462, 460, 463, 123/464, 469, 1 A, 337, 527, 529, 505, 510, 511; 261/DIG. 39; 440/88, 113; 114/138 R, 138 A, 211; 137/312, 313, 314; 48/192

[56] References Cited

U.S. PATENT DOCUMENTS

| | | | |
|---|---|---|---|
| 1,199,747 | 9/1916 | Benham | 261/DIG. 39 |
| 3,272,168 | 9/1966 | Donohue | 114/74 R |
| 3,646,924 | 3/1972 | Newkirk | 123/527 |
| 3,800,770 | 4/1974 | Baribeau | 123/139 AJ |
| 3,802,458 | 4/1974 | Wilmeth | 137/312 X |
| 3,903,646 | 9/1975 | Norton | 48/192 |

*Primary Examiner*—Trygve M. Blix
*Assistant Examiner*—Stephen P. Avila
*Attorney, Agent, or Firm*—Perry Carvellas

[57] ABSTRACT

To avoid danger of fuel leakage into bilges of a vessel's hull, the fuel feed pipe from the fuel supply to the vessel's engine carburetor is enclosed within a cylindrical casing sealed at one end to a fitting on the carburetor. At its other end the casing is sealed to an aperture in the hull, the feed pipe extending externally of the hull between the aperture and a container enclosing the fuel supply. Alternatively the casing is sealed at its other end directly to the container. The carburetor may have an annular fuel feed chamber with adjustable fuel orifices connected to the feed pipe through a scroll valve linked to the carburetor throttle valve.

11 Claims, 13 Drawing Figures

APPARATUS FOR FEEDING FUEL TO A MARINE ENGINE

This is a continuation of application Ser. No. 131,476, filed Mar. 18, 1980, abandoned.

This invention relates to apparatus for feeding fuel to an internal combustion marine engine.

There is a danger in vessels that fuel will collect in the bilges of the vessel if there is a slight leak. Such a collection of fuel, which may be gas or liquid, gives rise to a risk of explosion and if there is an explosion it may have disastrous consequences such as sinking the vessel or setting it on fire. An aim of the invention is to provide a reasonably inexpensive, yet safe and practical installation for feeding fuel to a marine engine, and for controlling the fuel feed.

According to the invention, there is provided apparatus for feeding fuel to marine engines which comprises a generally annular chamber having on its inner wall a series of peripherally-spaced orifices, a conduit connected to the annular chamber, a branch pipe secured to the conduit, and a helical rotary scroll valve member located in the conduit to obturate an adjustable proportion of the branch pipe opening dependent upon the rotational position of the scroll valve member, and a radial level connected to the valve member.

In accordance with one embodiment of the present invention there is provided apparatus for feeding fuel to a marine engine including a fuel feed pipe leading from a fuel storage container to a fuel intake of a carburetor, the pipe having one portion which is outside the hull of the vessel and a further portion which is inside the hull of the vessel, the apparatus also including a tubular gas- or liquid-tight casing which surrounds the whole length of the further portion of the feed pipe and extends to a fitting on the carburetor, the tubular casing at its end remote from the fitting being open to atmosphere.

With such an arrangement, the fitting is preferably constituted by the branch pipe, the latter being directly connected to the fuel feed pipe.

The radial level may be operated in response to movement of the butterfly valve in the carburetor.

A drain pipe is preferably located between an inlet flange associated with the carburetor and the hull of the vessel above the waterline.

The invention may be applied to a horizontal air intake flow type carburetor, or to a downdraft carburetor.

The invention may be applied whether the fuel is liquid or gas; for example the fuel could be petrol, any liquid hydrocarbon fuel, or low pressure hydrocarbon gas.

The tubular casing may be at least partly of flexible material.

The invention will be better understood from the following nonlimiting description of illustrative examples thereof, given with reference to the accompanying drawings in which.

Figure 1:
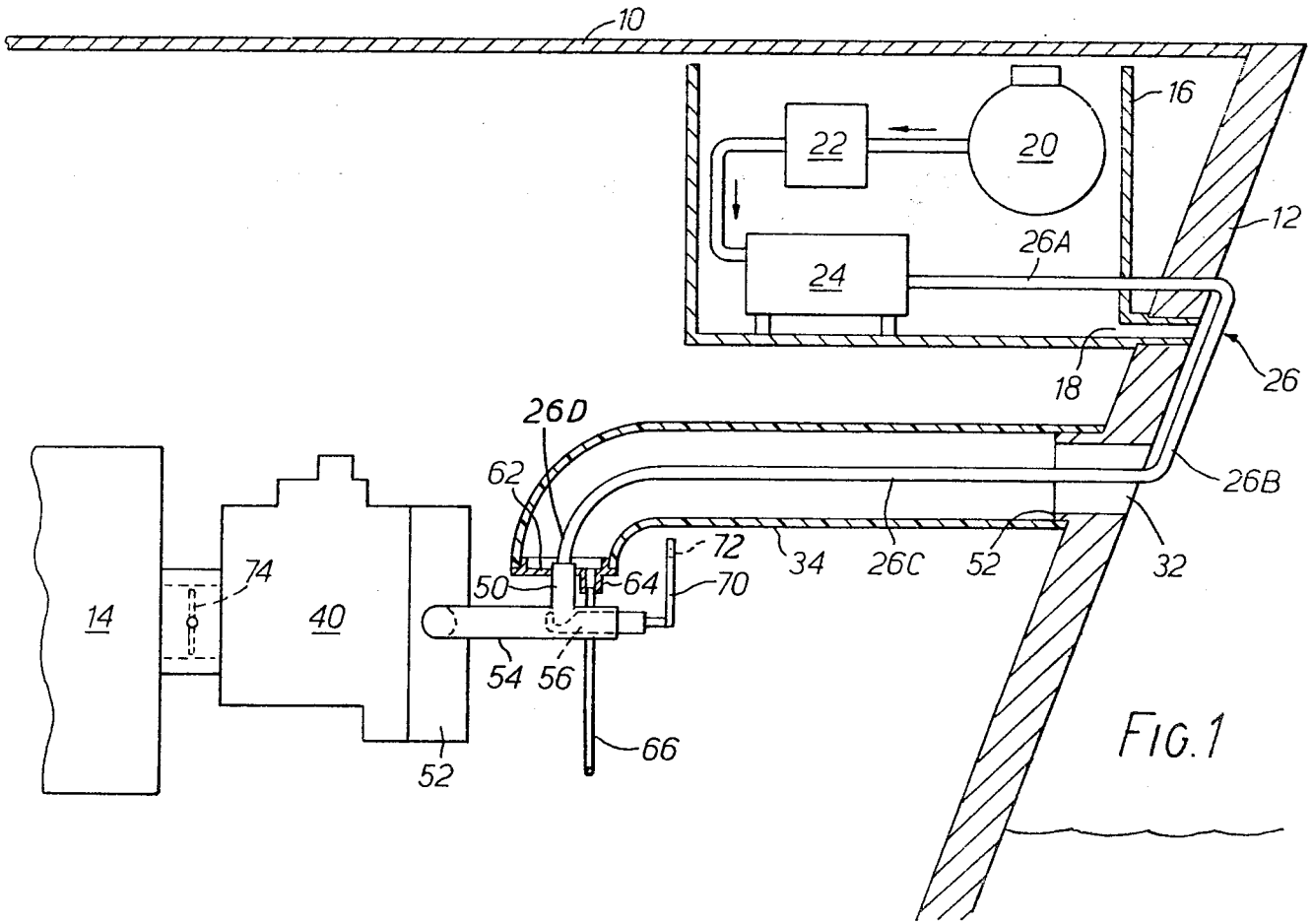
FIG. 1 is a diagrammatic longitudinal section through a rear part of a vessel in which one example of apparatus according to the invention is installed.
Figure 10:
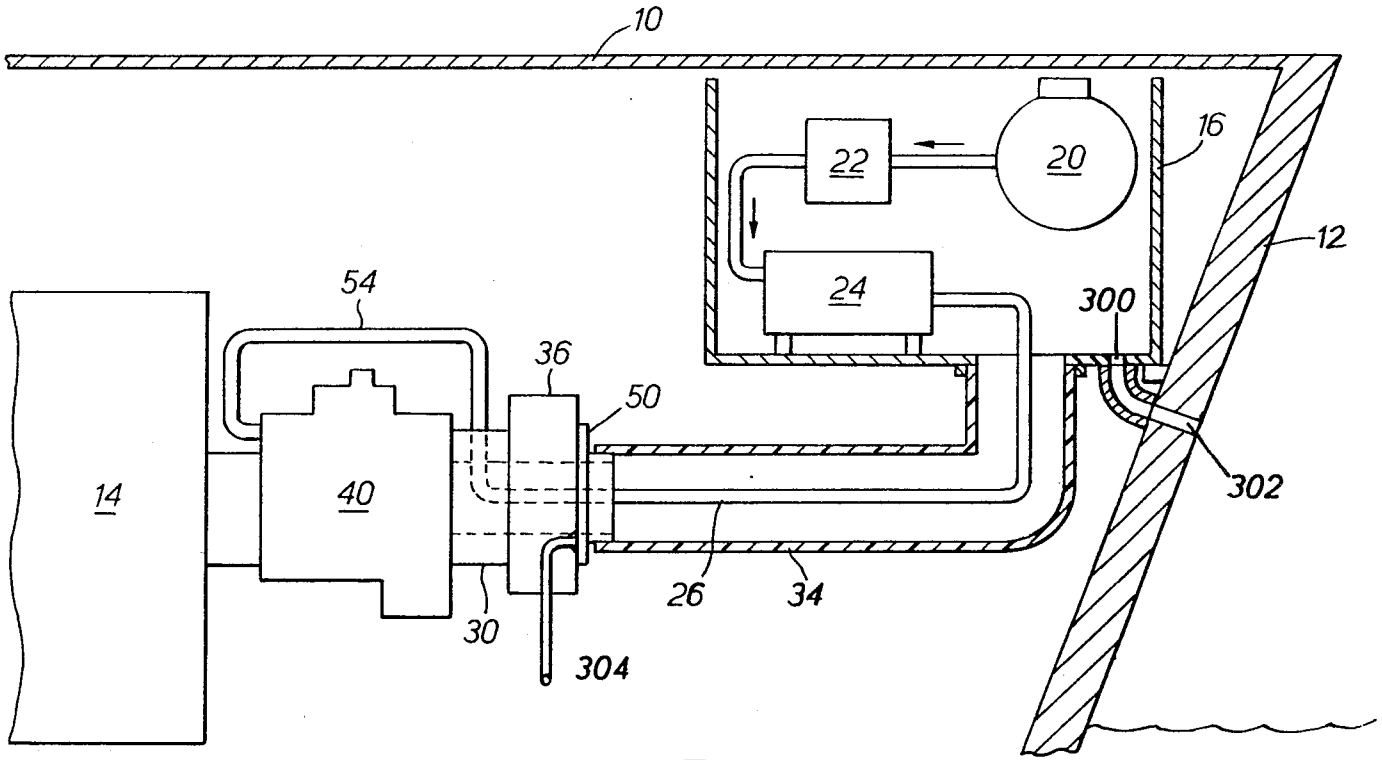
FIG. 10 is a diagrammatic longitudinal cross-section through part of a vessel in which a fourth example of apparatus according to the invention is included.
Figure 11A:
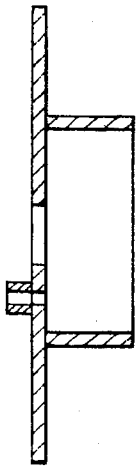
Figure 11B:
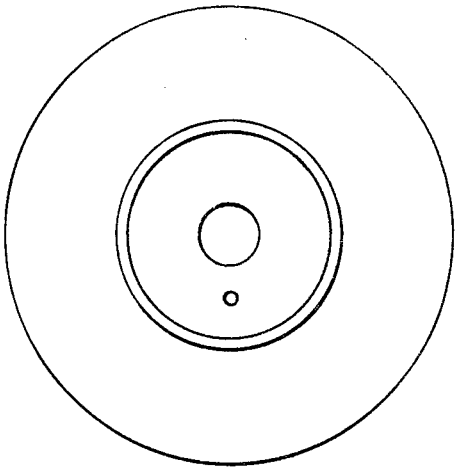
Figure 12:
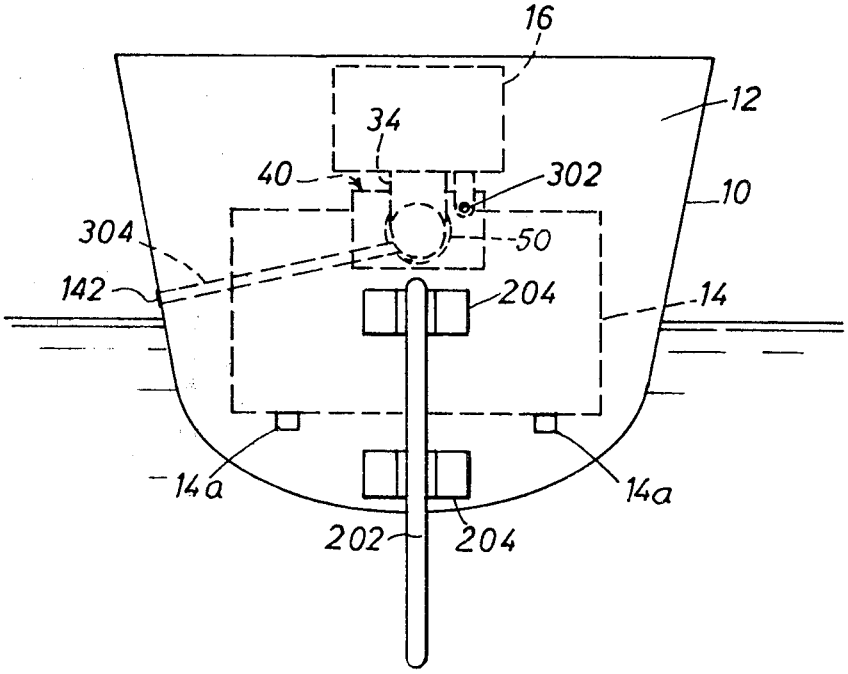

FIGS. 11*a* and 11*b* are an axial vertical section and a front view of a flange included in the apparatus of FIG. 1; and FIG. 12 is a rear view of a vessel embodying the example of the invertion shown in FIG. 10.

Referring to FIG. 1, a marine vessel has a deck 10, a transom 12, and an internal combustion engine 14. The remainder of the vessel is conventional and so is not shown. A container 16 with an open top has a drain hole 18 connected directly through the transom 12 to the outside. The illustrated vessel is intended to be propelled by LPG (liquefield petroleum gas) which is stored at high pressure and gasifies upon release of pressure. In the container 16 are a cylinder 20 of compressed LPG in liquid form, a fuel lock 22, and a liquid-to-gas converter 24. These are known items of equipment and therefore will not be described in detail. A gas feed pipe generally indicated at 26 extends from the converter 24 to a branch pipe 50. A first portion 26A of the pipe 26 passes through a wall of the container 16 and through the transom 12. A second portion 26B is outside the vessel. A third portion 26C passes through a hole 32 in the transom 12 and within a and through a tubular casing 34. A fourth portion 26D of the pipe 26 leads into the branch pipe 50.

Figure 2:
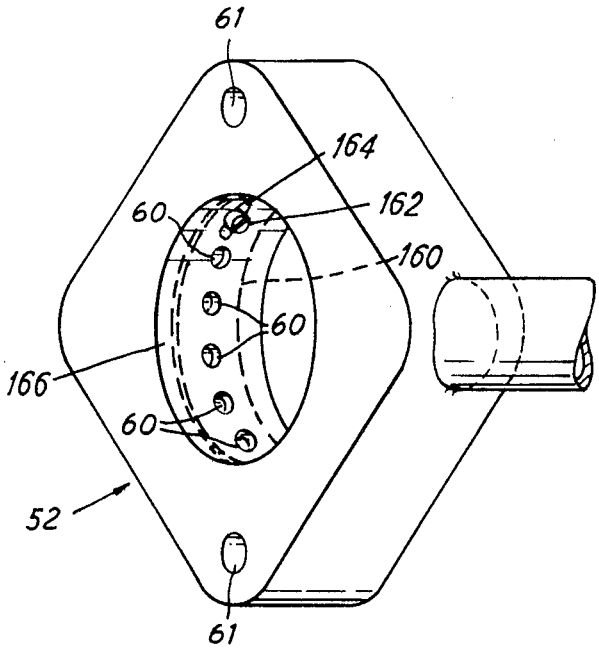
FIG. 2 is a perspective view of an annular chamber which forms part of the apparatus shown in FIG. 1.

The engine 14 is conventional and has a carburetor 40 of known design fixed thereto. An annular chamber 52 is secured to the carburetor 40 and has a conduit 54 projecting therefrom. This conduit 54 serves as a valve body for a helical rotary scroll valve member 56 which obturates the whole of the orifice formed by the branch pipe 50 in the conduit 54 when in its closed position, and which, when rotated, progressively exposes more of this opening so allowing LPG to flow into the conduit 54 and then into the hollow annular chamber 52. The latter is secured in a gas-tight manner to the carburetor 40 and the feed pipe 26D is secured in a gas-tight manner to the branch pipe 50. This coupling may for extra safety be located within the space enclosed by the tubular casing 34. The annular chamber has a series of peripherally-spaced orifices 60, FIG. 2, through which the fuel gas passes on its way to a combustion chamber of the engine 14. It may be bolted to the carburetor using bolt holes 61. The effective size of each of the orifices 60 is adjustable by means of an arcuate slide plate 160 located behind the wall 166 continuing the orifices. The slide plate 160 has a similar number of correspondingly sized and spaced orifices which can be brought into and out of strict register with the orifices 160 by sliding the slide plate. The slide plate is secured in any predetermined position by a screw 162 in the slide plate which extends through a slot 164 in the wall 166.

One end of the casing 34 is closed in a gas-tight manner by a flange 62,which has a small cup-shaped extension 64. The purpose of this cup-shaped extension is to collect any LPG which may have leaked within the casing 34 and conduct it away via a pipe 66 to the exterior of the vessel.

The valve member 56 has a boss on its outer end to which is securely fixed a radial lever 70. This has a hole 72 at its outer radial end to facilitate connection of a link or control cable (not shown) by which rotation of the lever about the axis of the scroll valve member 56, and hence rotation of the scroll valve member can be caused. The link or control cable referred to is attached to a suitable control mechanism so that when the carburetor butterfly valve 74 is opened the scroll valve member is rotated in an opening direction, and vice versa.

The tubular casing 34, which may be at least partly of a flexible material, for example a rubber or plastics bellows, is connected between the flange 62 and a flange 52 on the inner side of the transom and surrounding the hole 32. The connections are made at each end in such a way that LPG cannot leak therethrough. The flexible nature of the tubular casing 34 assists in ensuring that the integrity of these gas-tight connections is maintained even though there is relative vibration between the flange 62 (which vibrates with the engine) and the transom 12 of the vessel.

Referring now to FIGS. 3–8, a marine vessel has a deck 210, a transom 212, and an internal combustion engine 214. The remainder of the vessel is conventional and so is not shown. A container 216 with an open top and having a drain hole 218 connected directly through the transom 212 to the outside.

In the container 216 are a cylinder 220 of compressed LPG in liquid form, a fuel lock 222, and a liquid-to-gas converter 224. These are known items of equipment and therefore will not be described in detail. A gas feed pipe generally indicated at 226 extends from the converter 24 to an adaptor block 230. A first portion 226A of the pipe 226 passes through a wall of the container 216 and through the transom 212. A second portion 226B is outside the vessel. A third portion 226C passes through a hole 232 in the transom 212 and within and through a tubular casing 234. A fourth portion 226D of the pipe 226 passes through a flame trap 236 and the pipe 226 terminates at a suitable bore or fitting 230A (FIG. 6) in the adaptor block 230.

The engine 214 is conventional and has a carburetor 240 of known design fixed thereto. The adaptor block 230 is securely fixed, e.g. by bolts and suitable sealing washers, to the carburetor 240. The fixing is done in a gas-tight manner. The flame trap 236, which may also serve as an air cleaner, and which may consist of a casing or chamber having wire wool packing therein, is fixed in a gas-tight manner, to the adaptor block 230 in such a way that its interior is in communication with a central hole in the adaptor block, and, via said hole, with an air entry port of the carburetor 240. A flange member 250 is secured also in a gas-tight manner to another wall of the flame trap 236.

The tubular casing 234, which may be at least partly of a flexible material, for example a rubber or plastics bellows, is connected between the flange member 250 and a flange 252 on the inner side of the transom and surrounding the hole 232. The connections are made at each end in such a way that LPG cannot leak therethrough. The flexible nature of the tubular casing 234 assists in ensuring that the integrity of these gas-tight connections is maintained even though there is relative vibration between the flange member (which vibrates with the engine) and the transom of the vessel.

Figure 6:
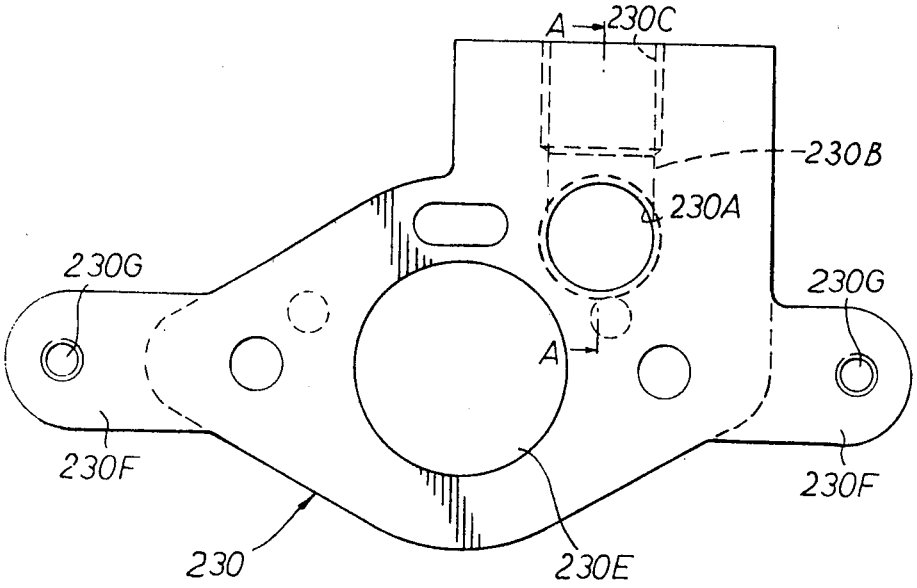
FIGS. 6 and 7 and 8 are views of one form of adaptor block, FIG. 6 being a front view, FIG. 7 being a side view, and FIG. 8 being a partial cross section on the line A—A of FIG. 4.
Figure 7:
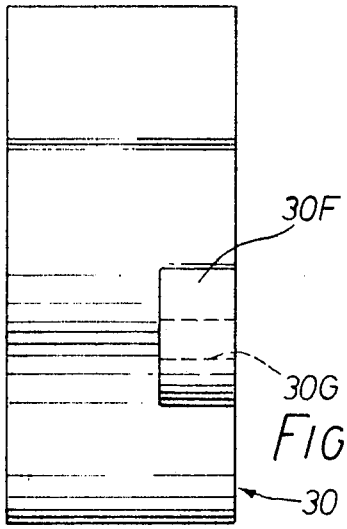
Figure 8:
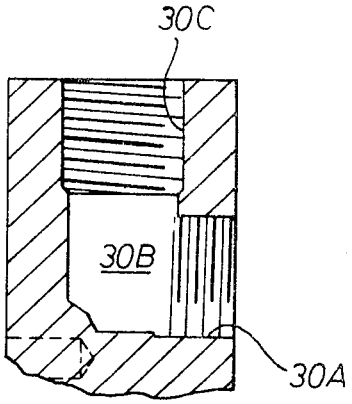

The adaptor block 230 has a central hole 230E, FIG. 6, and this serves as the air entry pathway for air sucked into the carburetor from outside the engine via holes in the flame trap 236. The gas feed pipe 226, surrounded over most of its length by the casing 234, is fixed to the fitting 230A of the block 230. From fitting 230A a bore 230B in the block extends to a fitting 230C. A rigid pipe 254 connects the fitting 230C with a fuel inlet port of the carburetor 240. The flange 252 is fixed in a gas-tight manner to the transom 212 and the casing 234. The adaptor block 230 has flanges 230F and holes 230G whereby it can be bolted to the carburetor 240. The block 230 may be made of aluminum alloy. The flange 252 and the flange member 250 could of course be replaced by other suitable fittings.

In a modified version of this embodiment of the invention, not illustrated, the separate adaptor block 230 and rigid pipe 254 are dispensed with, and the carburetor comprises a block containing its working parts and already provided with bores providing the pasageway from the end of the fuel feed pipe to the fuel entry port of the carburetor.

It will be realised that the arrangements so far described offer the possibility of feeding fuel to the engine with improved safety in marine vessels without undue complexity or expense. Even if there should be a leak between the pipe 226D and the fitting 230A in the block 230, or from the pipe 26C in FIG. 1, any escaping fuel cannot reach the bilges of the vessel but instead is conducted harmlessly to the exterior via the tubular casing 234 or via the pipe 66. Equally, any leak between or at the parts 20, 22, 24, 26A or their counterparts in FIG. 3 results in the fuel collecting in the bottom of the container from where it passes harmlessly to the exterior via the drain hole 18 or 218. The supply of air to the carburetor is not impeded, and only relatively slight modification of a conventional vessel is needed.

Figure 9:
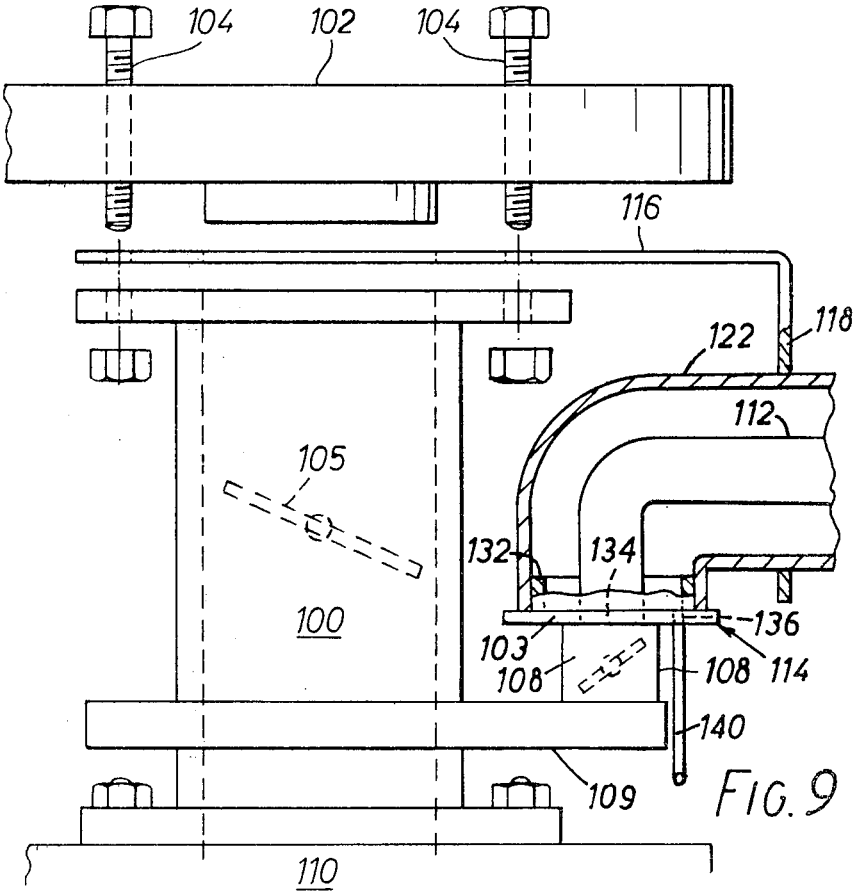
FIG. 9 is a side view of an example of the invention applied to a downdraft carburetor.

In the embodiment of the invention illustrated in FIG. 9, a downdraft carburetor 100 has an air intake at its top surface and carries thereon a flame trap 102, fixed for example by bolts 104. The air control butterfly is denoted by 105. A fuel inlet pipe 112 leads to a fuel control valve 108 and fuel flows therefrom into the body of the carburetor via a pipe 109. The engine inlet manifold is shown at 110. In accordance with this embodiment of the invention, the fuel feed pipe 112 is secured in a liquid- and gas-tight manner to the fuel control valve 108, using a flange 114 similar in essential function to the flange shown in FIG. 3. A right angle bracket 116 is clamped between the flame trap 102 and the carburetor 100 and has a downwardly depending flange 118 with a hole through which passes a tubular casing 122. The tubular casing 122 is connected in a liquid- and gas-tight manner to the flange 114. The tubular casing 122 extends from the flange 114 to the transom (not shown in FIG. 9) of the vessel, in a similar way to the tubular casing 34 of FIG. 1. The flange 114 (FIG. 9) comprises a flat plate 103 having a cylindrical sleeve 132 extending therefrom. The end of the tubular casing 122 fits tightly around the sleeve 132. The plate 103 has a generally central hole 134 through which passes the pipe 112 which is thereupon directly connected and sealed to the valve 108. The flange 114 also has a smaller, offset hole 136 therein which extends to an aperture surrounded by a short external cylindrical sleeve 138. A drain pipe 140 is sealed to this sleeve 138 and extends, for example laterally of the vessel at a point above the waterline. With such an arrangement, any fuel which leaks from the fuel feed pipe 112 is prevented from descending into the bilges of the boat but instead passes to atmosphere through the drain pipe 140. In this way, the likelihood of an explosion through escape of gas or liquid fuel is reduced virtually to zero.

Figure 3:
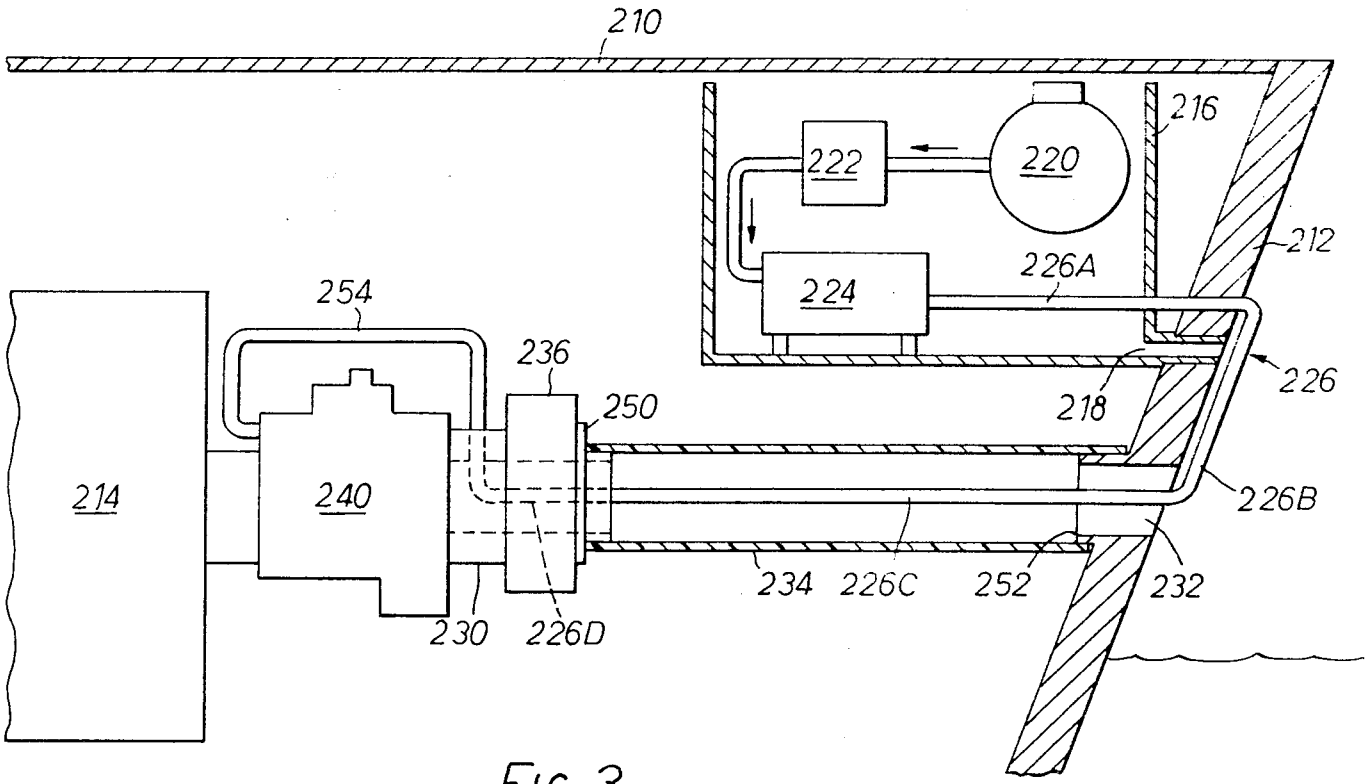
FIG. 3 is a diagrammatic longitudinal cross-section through a rear part of a vessel in which a second example of apparatus according to the invention is installed.
Figure 4:
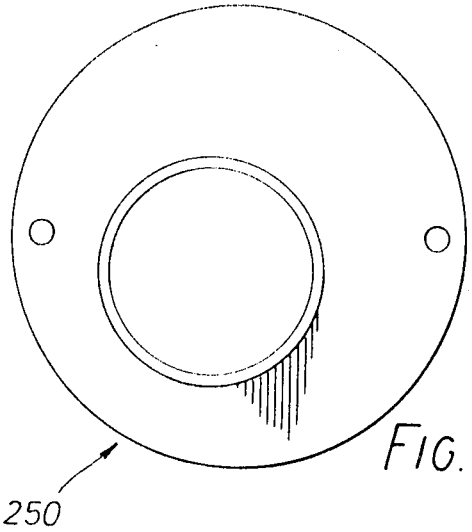
FIGS. 4 and 5 are respectively front and side views of a flange included in the apparatus of FIG. 3.
Figure 5:
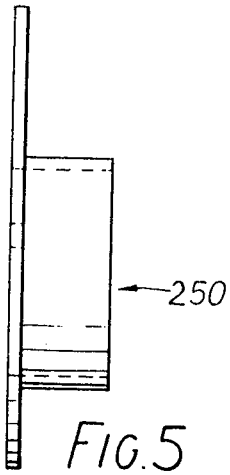

FIG. 10 depicts a vessel including apparatus according to the invention which is slightly modified compared to FIGS. 1 and 3. In FIGS. 1 and 10, like parts bear like reference numerals. The container 16 has a drain hole 300 leading to an exit hole 302 in the transom 12. The tubular casing 34 has a bend therein, and terminates in a flange 50 whose construction can readily be seen from FIGS. 11*a* and 11*b*. A drain pipe 304 leads from the flange 50 to the exterior of the hull of the vessel, above the waterline. With this arrangement, any leakage of fuel whether gas or liquid is conducted to the exterior either via the exit hole 302 or the drain pipe 304, and cannot enter the bilges of the vessel.

FIG. 12 illustrates a vessel incorporating the example of the invention shown in FIG. 10 seen looking forward. The vessel has a hull 10, a transom 12, a rudder 202, rudder pintles 204, an engine 14 (supported on structural members 14*a*), and a carburetor 40. A tubular casing 34 extends from a container 16 to a flange 50. The drain pipe 304 extends from the flange 50, laterally of the vessel, to an outlet 142 located above the waterline.

What is claimed is:

1. Apparatus for feeding liquified petroleum gas fuel which is gasified and fed to the carburetor of an internal combustion engine comprising a generally annular chamber having an inner wall provided with a plurality of peripherally spaced orifices and connectible to a fuel feed pipe and mountable on the carburetor such that gasified fuel flows through the orifices thereof to the carburetor, a conduit connected to the annular chamber, a branch pipe connected to the conduit to provide a fuel duct from the fuel feed pipe to the conduit, a helical rotary scroll valve located in the conduit to obturate an adjustable proportion of the branch pipe opening into the conduit dependent upon the rotational position of the scroll valve, a radial lever connected to the scroll valve to cause rotary motion thereof, an adjustment means for the area of the annular chamber orifices comprising a slide plate having further orifices corresponding to the chamber orifices and movable to bring the chamber orifices and further orifices progressively into and out of strict register, and means for clamping the slide plate at any required position within its range of movement.

2. Apparatus according to claim 1 for feeding fuel to a marine engine of a vessel and including a fuel feed pipe leading from a fuel storage container to a fuel intake of a carburetor of said engine, said pipe having a portion which is external of the hull of the vessel driven by the engine and a portion which is internal of the hull of the vessel; and further including an elongated fluid-tight casing surrounding the said internal portion of said pipe and sealingly connected at one end to a fitting on said carburetor, the other end of said casing being open to atmosphere externally of the vessel hull.

3. Apparatus according to claim 1 for feeding fuel to a marine engine of a vessel and including a fuel feed pipe leading from a fuel storage container within an outer container to a fuel intake of a carburetor of said engine, and an elongated fluid-tight casing surrounding said feed pipe and having one end sealingly connected to a fitting on said carburetor and the other end sealingly connected to said outer container.

4. Apparatus according to claim 3 wherein drain pipes extend from said fitting and said outer container externally of the hull of a vessel driven by said engine.

5. Apparatus according to claim 3 wherein said fitting is secured to a flame trap of said carburetor.

6. Apparatus according to claim 1 wherein said branch pipe is connected to a fuel feed line which is enclosed within a casing which is sealed at one end to a flange sealed around the branch pipe and is sealed at the other end, to an orifice extending through a vessel hull containing the marine engine.

7. Apparatus according to claim 2 wherein said fitting is provided with a drain leading externally of the hull.

8. Apparatus according to claim 2 wherein said fitting is a flange mounted on a branch pipe of a conduit containing fuel feed valve means to said carburetor.

9. Apparatus according to claim 1 wherein said fitting is a flange mounted on said carburetor.

10. Apparatus according to claim 2 wherein said fitting is a flange mounted on a flame trap on said carburetor.

11. Apparatus according to claim 2 wherein said fuel storage container is located within an outer container having a drain pipe extending to the exterior of the hull.

* * * * *